US005085628A

United States Patent [19]

Engebretson et al.

[11] Patent Number: 5,085,628

[45] Date of Patent: Feb. 4, 1992

[54] IMPLANTABLE HEARING AID COUPLER DEVICE

[75] Inventors: A. Maynard Engebretson, Ladue; John Fredrickson, Clayton, both of Mo.

[73] Assignee: Storz Instrument Company, St. Louis, Mo.

[21] Appl. No.: 420,292

[22] Filed: Oct. 12, 1989

Related U.S. Application Data

[63] Continuation-in-part of Ser. No. 242,365, Sep. 9, 1988, Pat. No. 4,988,333.

[51] Int. Cl.[5] ..... H04R 25/00

[52] U.S. Cl. ..... 600/25; 381/153

[58] Field of Search ..... 600/25; 128/420, 66.87, 128/715, 733, 774, 782; 367/152, 168, 182; 381/68, 68.3, 151, 153, 154, 171, 177, 187, 192; 310/321, 322, 326, 328, 334

[56] References Cited

U.S. PATENT DOCUMENTS

| | | | |
|---|---|---|---|
| 622,328 | 4/1899 | Collins | 381/68 |
| 2,702,354 | 2/1955 | Chorpening | 128/715 |
| 3,346,704 | 10/1967 | Mahoney | 179/107 |
| 3,633,217 | 1/1972 | Lance | 3/1 |
| 3,674,945 | 7/1972 | Hands | 381/153 |
| 3,676,611 | 7/1972 | Stephens | 179/107 G |
| 3,763,333 | 10/1973 | Lichowsky | 179/107 R |
| 3,771,173 | 11/1973 | Lamb, Jr. | 3/1 |
| 3,842,440 | 10/1974 | Karlson | 3/1 |
| 3,870,832 | 3/1975 | Frederickson | 179/107 G |
| 3,882,285 | 5/1975 | Nunley et al. | 179/107 G |
| 3,919,722 | 11/1975 | Harmison | 3/1.7 |
| 3,974,825 | 8/1976 | Normann | 128/1 D |
| 4,143,661 | 3/1979 | LaForge et al. | 128/419 R |
| 4,213,207 | 7/1980 | Wilson | 3/1.7 |
| 4,251,686 | 2/1981 | Sokolich | 381/154 |
| 4,357,497 | 11/1982 | Hochmair | 381/68 |
| 4,369,530 | 1/1983 | Robinson et al. | 3/1.7 |
| 4,428,377 | 1/1974 | Zollner et al. | 128/419 R |
| 4,441,210 | 4/1984 | Hockmair et al. | 179/107 G |
| 4,542,532 | 9/1985 | McQuilkin | 433/78 |
| 4,606,329 | 8/1986 | Hough | 600/25 |
| 4,611,598 | 9/1986 | Hortmann | 128/419 R |
| 4,662,358 | 5/1987 | Farrar et al. | 128/1 D |
| 4,665,896 | 5/1987 | LaForge et al. | 128/1 D |
| 4,666,443 | 5/1987 | Portner | 623/3 |
| 4,729,366 | 3/1988 | Shaefer | 128/106 |

OTHER PUBLICATIONS

IEEE Engineering and Medicine in Biology Magazine, Jun. 1987, p. 37.

Frederickson et al. "Evaluation of an Electromagnetic Implantable Hearing Aid", Jun. 1972.

Hough et al., "Middle Ear Implantable Hearing Device: On-Going Animal and Human Evaluation" Ann Otol Rhinol Laryngol 97:1988.

Goode, "Current Status of Electromagnetic Implantable Hearing Aids", Otolaryngologic Clinics of North America.

Hough et al., "Implantable Bone Conduction Hearing Device Audiant Bone Conductor", Ann Otol Rhinol Laryngol 95:1986.

Yanagihara et al., "Implantable Hearing Aid", Arch Otolaryngol Head Neck Surgery, vol. 113, Aug. 1987.

*Primary Examiner*—William E. Kamm

*Attorney, Agent, or Firm*—Brooks & Kushman

[57] ABSTRACT

The acoustical coupler has a closed-bottom containment with compliant diaphragm attached to the containment periphery to form an acoustic chamber. A length of tubing is connected through the side or bottom or the containment of the chamber for conveying sound pressure between the chamber and an electroacoustic transducer connected at the other end of the tubing. The transducer may be either a microphone or a hearing aid receiver. The electroacoustic transducer, being too large for direct placement within the middle ear cavity may be located elsewhere in the skull, such as behind the ear adjacent to the surface of the skin. When connected to a microphone, the coupler may be placed within the middle ear cavity behind the tympanic membrane and may be attached to the malleus with a wire hook secured to the coupler diaphragm. When attached to a vibration sending unit the coupler may transfer the generated vibration directly to the incus end of the stapes. In one embodiment, this transfer is effected by means of a hollow tube having a generally hollow member therein and containing a quantity of low loss material. The member defines one end connected to the vibration sending unit and a second end connected directly to the stapes.

9 Claims, 3 Drawing Sheets

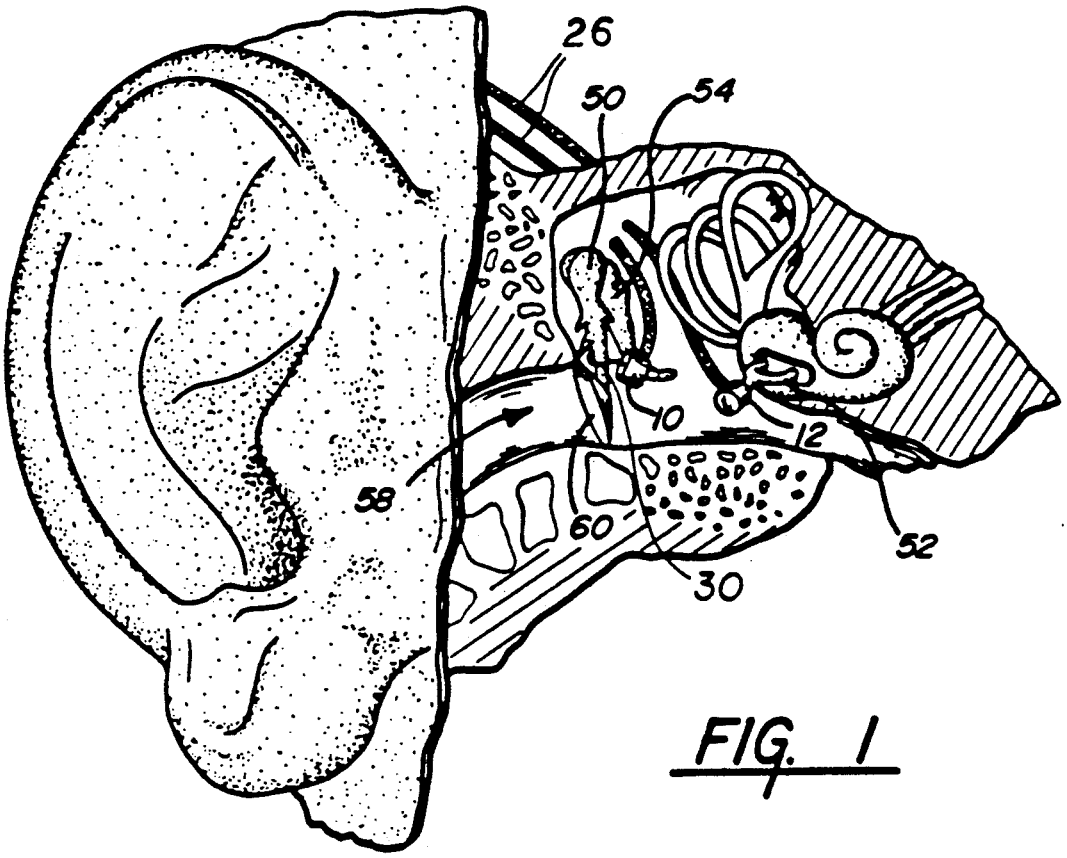
FIG. 1
FIG. 2
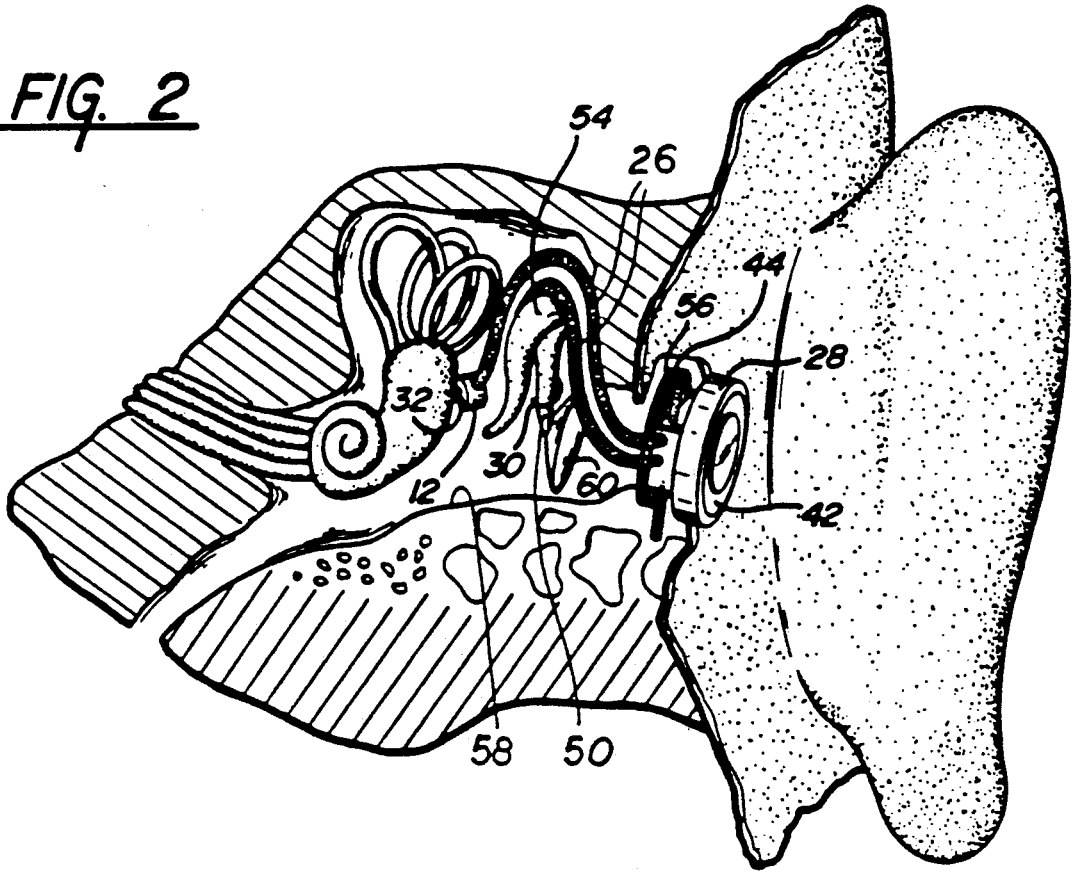

IMPLANTABLE HEARING AID COUPLER DEVICE

CROSS REFERENCE TO RELATED APPLICATION

This application is a continuation-in-part of Application Ser. No. 242,365, filed on Sept. 9, 1988, now U.S. Pat. No. 4,988,333.

BACKGROUND AND SUMMARY OF THE INVENTION

The present invention relates generally to the implantable hearing aids and more particularly to implantable hearing aids for direct coupling to the middle ear. The invention may be directly coupled to the cochlea via the stapes or to other elements within the ossicular chain.

The implantable hearing aid is intended to help a specific class of patient for which conventional hearing aids are inadequate. These patients have severe hearing impairments and require excessive amplification that is limited by acoustic feedback an sound distortion. Patients have reported an increased clarity of sound and were able to identify speech equal to or better than that reported with conventional aids by using amplified sound directly coupled to the stapes.

The performance of conventional hearing aids has improved markedly over the past ten years. However, there remains a significant population of hearing impaired patients for whom these aids are inadequate. A previously estimated population of approximately one million in the United States alone have hearing impairments that are characterized by severe hearing loss and a need for high levels of sound amplification. The high power required by these patients is difficult to achieve with the small, inconspicuous receivers used in hearing aids because of the significant mismatch between the acoustic impedance of the receiver and the ear.

Problems with these aids include: (1) inefficient energy conversion resulting in excessive power consumption and short battery life, (2) acoustic feedback resulting in oscillation and squeal, and (3) distortion of the signal from a variety of factors resulting in reduced clarity of sound and reduced speech intelligibility.

Due to impedance mismatch, conventional aids are inefficient. It has been documented that at a sound pressure of 100 dB SPL, the acoustic power absorbed by the ear is about 0.1 microwatt. The corresponding electrical power supplied to the hearing aid receiver operating at this level is about 0.3 milliwatts (300 microwatts). The conversion efficiency is less than 0.3 percent. In contrast, the conversion efficiency of a well designed acoustic horn and driver is between 10 percent and 50 percent. This sizable discrepancy in efficiency between the hearing aid and horn driver is a direct consequence of the relative impedances of the transducer and the acoustic impedance of the load on the transducer. By coupling directly to the stapes, a better impedance match is achieved and the system can be made more efficient. A tenfold improvement in efficiency would result directly in extending the battery life of the aid.

A second problem with conventional high-power hearing aids is acoustic feedback. In order to isolate the output of the aid from the input microphone, patients are required to wear tightly-fitting earmolds. These tightly-fitting earmolds are uncomfortable for the patient and the complete occlusion of the ear canal causes an unpleasant sensation and initially makes the patient's own voice sound unnatural. In addition, the amount of isolation that can be achieved with a closed earmold is limited by the acoustic properties of available materials and even the best fitting earmold will lose its seal as a result of jaw motion and external ear movement. These problems can be solved with the use of direct vibratory stimulation of the stapes. Although some sound will radiate from the cochlea, it will be greatly attenuated because of the small impedance of the ear canal versus the high acoustic impedance of the transducer and fluid-filled cochlea.

A third problem with conventional hearing aids is the distortion produced by the receiver and the middle ear at high sound pressures. Distortion results in a loss of clarity of sound and a reduction in speech intelligibility for the patient. It has been illustrated that a speech hearing loss due to attenuation can be corrected with amplification, whereas a speech hearing loss due to distortion cannot. The distortion inherent in an abnormally functioning inner ear makes it impossible for the patient to recognize individual phonemes of speech with 100 percent accuracy under quiet listening conditions. When this inherent distortion is coupled with that caused by conventional hearing aids (i.e., acoustic feedback, acoustic resonances and antiresonances due to receiver and connective tubing and middle ear distortion) the sum of the individual sources of distortion on speech intelligibility is similar to that of decreasing the speech-to-noise ratio at the input to the hearing aid. Since a normal hearing individual has only a margin of 8 dB in a typical noisy environment such as a busy department store or restaurant, an equivalent loss of 8 dB due to distortion can become a major handicap. As previously mentioned, with middle ear vibrators, patients have reported that the sound perceived via direct stimulation of the stapes is clearer and less distorted when compared with the sound produced by conventional aids. From these results, it appears that driving the stapes directly can eliminate much of the distortion of conventional aids.

Concerning utility, an important aspect of hearing aid design is its utility for the wearer which includes factors such as patient comfort, convenience of use, sound quality and aesthetics. Utility of the design plays an important role in patient acceptance and must be included in the evaluation of a device. In the past, the emphasis on whether an aid is satisfactory has been determined primarily by speech intelligibility testing. Previous evidence implies that if a patient is given a choice, he will prefer to operate the aid (initially) at a setting that provides better sound quality rather than maximum intelligibility. In the same way, patients are likely to prefer to wear a device that is more comfortable and less conspicuous. These issues of utility can be best served by an implantable hearing aid. However, presently available microphones (acoustical-to-electrical transducers) and receivers (electrical-to-acoustical transducers) are too large and ill-suited for placement within the middle ear.

The present invention makes it possible to use existing transducers, without significant modification to the middle ear while retaining the advantages of implanted middle ear assistance devices. The present invention provides an acoustic coupler which is preferably hermetically sealed for direct insertion into the middle ear cavity. The acoustic coupler is sized to fit within the middle ea cavity without significant surgical alteration of the cavity. It can be attached to a microphone located remote from the middle ear cavity for acoustically coupling the microphone with the malleus or the tympanic membrane. The coupler may also be used in reverse when attached to a receiver to act as a vibrator for causing mechanical vibration of the stapes.

The acoustic coupler, in one embodiment, comprises a chamber-forming member across which a compliant diaphragm or membrane is attached. Connective tubing couples the chamber with a selected electroacoustic transducer (e.g., microphone or receiver). The connective tubing is preferably acoustically matched so that a substantially constant acoustical impedance is maintained. The connective tubing system includes a tuning portion forming a terminated or closed end, resonant at even harmonics and an open end, resonant at odd harmonics. The resultant acoustical coupler is suitable for direct placement within the middle ear cavity and serves an acoustical coupling for transmission of acoustical energy between the coupler diaphragm at one end and the electroacoustic transducer at the other. The coupler diaphragm may be physically coupled to the handle of the malleus by a wire hook or it may be positioned to acoustically couple with the tympanic membrane when used as a microphone. When used as a transmitter or vibrator, the diaphragm can be physically attached to the stapes via an intermediate wafer adhered to the membrane and also attached to the stapes. Preferably the wafer is porous such as ceramic and becomes fused to the stapes by tissue growth. Alternatively, a tube having a moveable piston therein which is mechanically coupled to the coupler receiver may be attached to the stapes.

For a more complete understanding of the invention, its objects and advantages, reference may be had to the following specification and to the accompanying drawings.

BRIEF DESCRIPTION OF THE DRAWINGS

FIGS. 1 and 2 illustrate, respectively, front and rear views of the human ear with one form of the invention implanted therein;

DESCRIPTION OF THE PREFERRED EMBODIMENT

Figure 3:
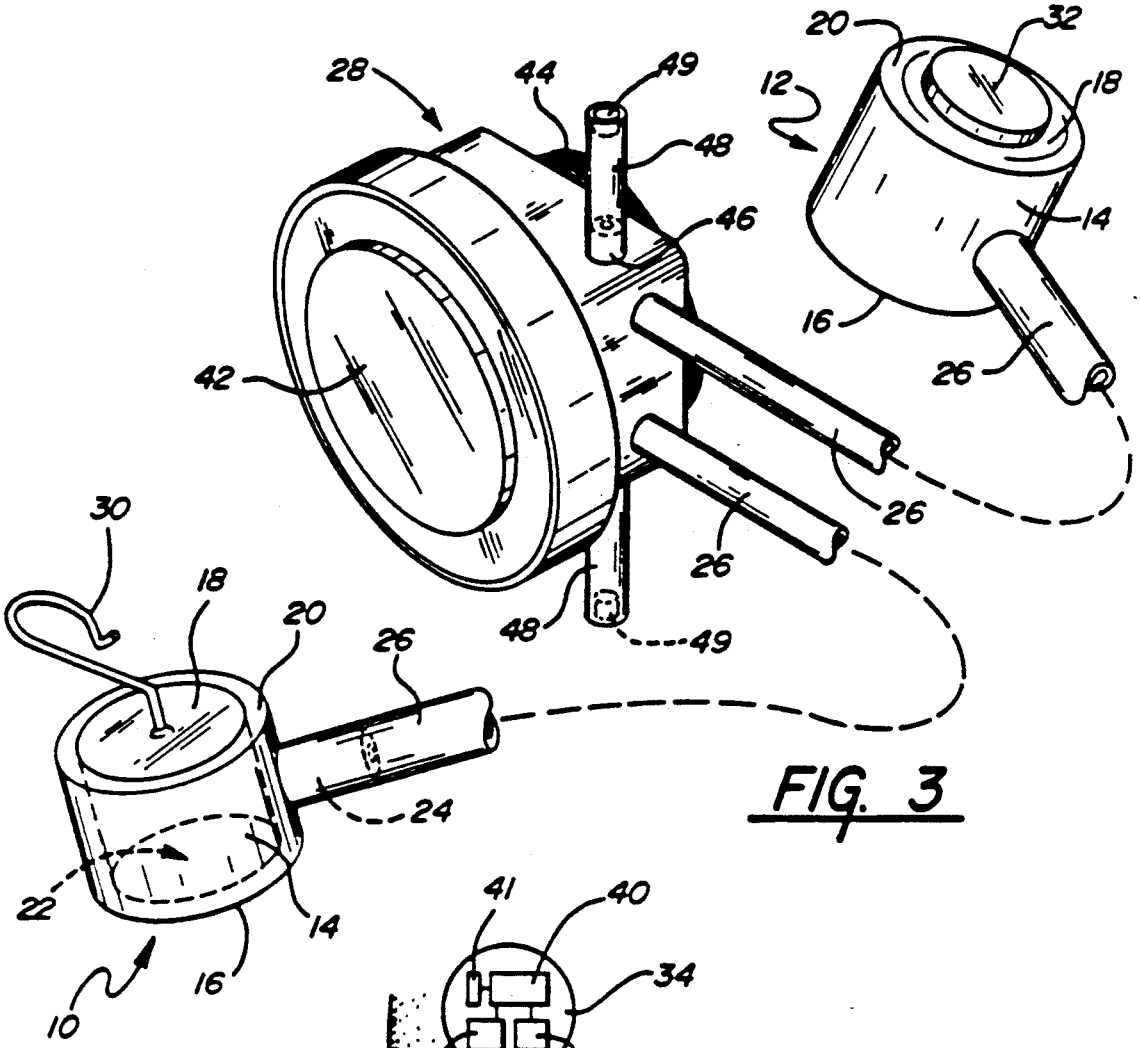
FIG. 3 is a detailed perspective view of the invention in one embodiment.

The present invention, in a first embodiment, provides an acoustic coupler which may be used for both sound pick up and sound delivery systems. In order to illustrate both of these uses, FIG. 3 illustrates the presently preferred embodiment in a configuration providing both sound pick up and sound delivery systems. Referring to FIG. 3, a sound pick up coupler 10 and a sound delivery coupler 12 are illustrated. The sound pick up and delivery couplers both comprise a cylindrical containment member 14 with closed end 16. A flexible and compliant diaphragm or membrane 18 is stretched across and sealed to the outer circular periphery 20 of containment member 14 to define a sound chamber 22. Preferably diaphragm 18 is fabricated from a 0.10 mm thick film of synthetic rubber material which can be obtained from Dow Corning Company under the brand name Silastic®. The diaphragm may be affixed to periphery 20 using Silastic® Type A adhesive also available from Dow Corning Company. Although the size may vary somewhat depending upon the application, the containment member is of a sufficiently small size to fit within the middle ear cavity, generally as illustrated in FIGS. 1 and 2. The presently preferred containment member has an outer diameter of 3.00 mm when measured across circular periphery 20. The diaphragm is attached to the circular periphery without placing the diaphragm under tension, so that the resulting installed diaphragm is free to flex up and down in the auditory frequency range.

Containment member 14 is provided with a nipple 24 which communicates with sound chamber 22 and which receives the end of a length of tubing 26. Tubing 26 is coupled at the opposite end to the sound reinforcement and processing package 28, which is preferably located outside the middle ear cavity as illustrated in FIGS. 1 and 2. Although the presently preferred containment member 14 and tubing 26 are air filled, other fluids may be used.

When used as a sound pick up, such as pick up coupler 10, a wire hook 30 can be attached as with adhesive to the center of diaphragm 18. The hook is shaped to attach to one of the ossicular bones within the ear and serves to physically couple movement of the ossicular chain to diaphragm 18, to thereby introduce acoustical energy into sound chamber 22, allowing transmission of the acoustic energy through tubing 26 to microphone 36.

When used as a sound delivery coupler, such as coupler 12, diaphragm 18 is provided with a disc 32, suitably secured to the diaphragm as with adhesive. The disc is preferably porous or fibrous material, such as ceramic and is intended to be placed in contact with a selected ossicular bone, the porous nature of the disc permitting tissue to grow into and fuse with the disc. The disc thereby couples acoustical energy carried by movement of diaphragm 18 to the desired ossicular bone for further processing by the human ear. Although the current embodiment uses a stiff ceramic disc, a compliant disc may decrease the restriction of diaphragm movement caused by gluing a ceramic disc in the center.

It is to be understood that the above-described means of attachment to the selected ossicular bones are presently preferred, although there are other alternate means for effecting acoustical coupling between the diaphragm and the ossicular member of interest. Intermediate lever arms may be used to couple the diaphragm to an element of the ear, for example. Also, where direct physical coupling is not required, pick up coupler 10 can be fashioned without wire hook. In this instance, the diaphragm 18 is positioned within the middle ear either in contact with or behind the tympanic membrane of the ear so that movement of the tympanic membrane imparts a corresponding movement in diaphragm 18 by direct contact in the first case or by sound pressure variations in the entrapped air volume of the middle ear in the second case. In such an application, it may be necessary to give attention to placement of the coupler so that it does not lie on a standing wave null point within the middle ear cavity.

Furthermore, while the porous or fibrous disc is the presently preferred means for attachment to the stapes, oval window or other ossicular member, other techniques can be employed. For example, the diaphragm may be attached to the stapes using magnets. A first magnet is attached to the diaphragm 18, on either the inner surface or the outer surface, and a bumper of ferrous material is adhered to the stapes. The magnet and ferrous bumper are attracted to one another by the Newton traction force and create a mechanical coupling between the membrane and the ossicular member. Adhesive materials can also be used to attach the diaphragm directly to the stapes or other ossicular member.

Figure 4:
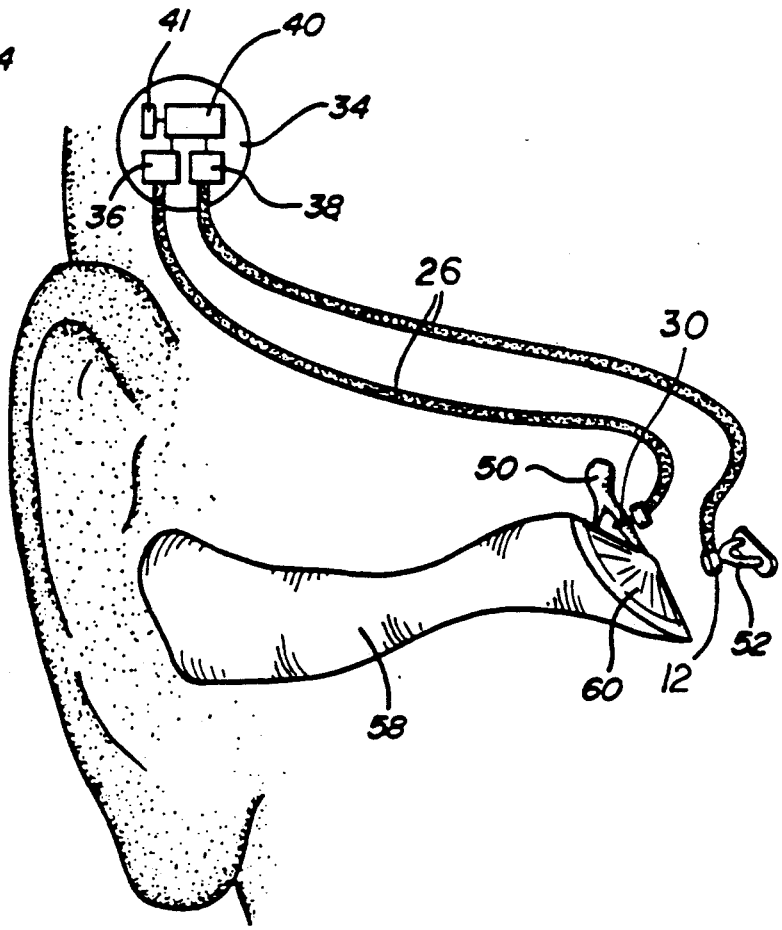
FIG. 4 is a schematic view illustrating the invention shown in FIG. 3 in use.

The sound reinforcement and processing package 28, also illustrated in FIG. 4, preferably comprises a circuit board or substrate 34 to which a miniaturized microphone 36 and hearing aid receiver 38 are attached. The microphone and receiver are electrically connected to the desired amplification and signal processing electronic circuitry 40 which may be embodied in integrated circuits surface mounted or otherwise attached to circuit board 34. To provide electrical power for operating the electronic circuitry, a battery 42 (FIG. 3) is secured to and electrically connected to one side of circuit board 34. Preferably the battery is rechargeable and the electronic circuitry includes an inductively coupled circuit means 41 for recharging the battery. In this regard, circuit 41 includes an electromagnetic coil 44 provided as part of the package 28 (FIG. 3). The coil is positioned near the surface of the skin of the patient and forms the secondary windings of a transformer. When it is desired to recharge battery 42, an external coil is placed on or near the skin adjacent the secondary coil 44 forming the primary windings of a transformer. The primary and secondary coils are electromagnetically coupled with one another to form a transformer through which electrical energy is conveyed to charge battery 42.

In order to provide proper termination and to smooth standing wave resonances at both the microphone 36 and receiver 38, microphone 36 and receiver 38 are each provided with a fitting 4 which communicates with the interior cavity of the microphone and receiver, respectively. In FIG. 3, two such fittings 46 are illustrated, one communicating with the microphone and one communicating with the receiver (both housed within package 28). A short length of tubing 48 is attached to each fitting and the opposite end of the tubing is fitted with a ceramic plug 49 serving to close the end of the tubing. This short length of tubing, along with the sound delivery tube to the chamber and dampers with impedance equal to the characteristic impedance of the tubing, provides a relatively constant acoustical impedance for proper termination of the microphone and receiver units. The closed end of tubing 48 provides proper termination of the even harmonics, whereas the tubing 26 connected to the coupler acts as an open-ended tubing, thereby providing a good acoustical match at the odd harmonics. By providing both even and odd harmonic matching, a substantially constant acoustical impedance results with a sufficiently wide bandwidth for conveying acoustical signals in the human hearing range. For more information on the use of acoustic termination see E. V. Carlson, "Smoothing The Hearing Aid Frequency Response," *Journal of the Audio Engineering Society*, July/August 1974, Vol. 22, No. 6.

FIGS. 1 and 2 illustrate one use of the invention wherein pick up coupler 10 is attached by means of hook 30 to the malleus 50. The delivery coupler 12 is attached by means of ceramic disc 32 to the incus end of the stapes 52. As illustrated, the ossicular chain is dearticulated by disconnecting two of the ossicular bones, such as at the connection between stapes 52 and incus 54. The incus 54 may be removed to provide space and so as not to interfere with movement of the stapes now under control of delivery coupler 12. Pick up coupler 10 is held in place by hooking onto the malleus and delivery coupler 12 is held in place by affixing to a bone pin, or the like, secured to the bone mass adjacent the middle ear cavity. The couplers may be installed by making the appropriate incision and opening behind the ear as illustrated in FIG. 2 at 56. Opening 56 may then be used to receive the sound reinforcement and processing package 28, with either the secondary coil 44 or battery 42 being positioned immediately beneath the skin.

In use, the acoustic coupler sound pick up and delivery system as illustrated in FIGS. 1 and 2 works as follows. Sounds enter the ear canal 58 and impinges upon the tympanic membrane 60, causing it to vibrate. The tympanic membrane, being attached to the malleus 50, thus imparts vibratory movement to the malleus. In a normal ear this movement of the malleus is transmitted through the incus 54 to the stapes. However, since the incus and stapes have been dearticulated, this movement is no longer communicated through to the stapes. Instead, movement of the malleus acts through hook 30 to cause the diaphragm 18 of pick up coupler 10 to vibrate. Vibration of the pick up coupler diaphragm causes changes in the sound pressure levels within the sound chamber 22 of the pick up coupler. These pressure changes are transmitted through tubing 26 to the microphone 36. Microphone 36 converts the sound pressure level changes into electrical signals which are processed by the amplification and signal processing circuitry 40 in accordance with the needs of the particular patient.

In many cases, the signals will be amplified and may be additionally filtered to emphasize or de-emphasize various frequency ranges. Either analog or digital processing of the electrical signals can be employed. For example, if the patient has a profound hearing loss at most speech frequencies but has normal hearing at the low and high end of the human hearing spectrum, then the signal processing would increase the amplitude of signals at the speech frequencies while leaving the remaining frequencies unchanged. Using digital techniques, the electronic signal processing can be quite precise and quite frequency-selective, as needed. The objective of this signal processing is to provide a signal which compensates for deficiencies in the patient's hearing, in an effort to provide as much hearing as is possible.

After electronic amplification and signal processing, the electrical signal is fed to receiver 38 which converts the electrical signals back into sound pressure level changes which are then coupled through the delivery coupler tubing 26 to the delivery coupler 12. The sound pressure level changes within delivery coupler 12 cause the corresponding diaphragm 18 and ceramic disc 32 to vibrate at an amplitude and frequency corresponding to the amplitude and frequency of the sound waves which entered the ear canal (as modified by the electronic processing). This vibration is transmitted to the stapes which then acts in usual fashion.

Figure 5:
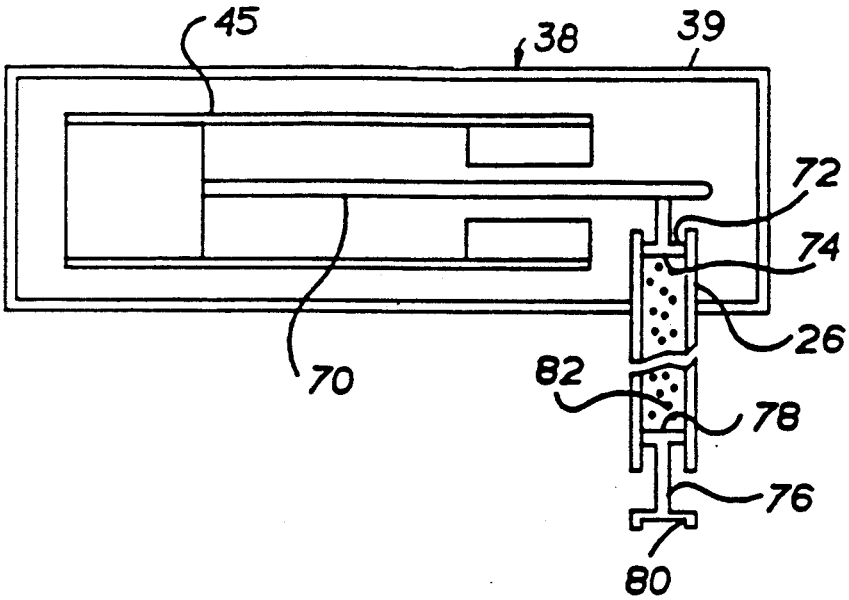
FIG. 5 is a detailed perspective view of the invention in a second embodiment.
Figure 6:
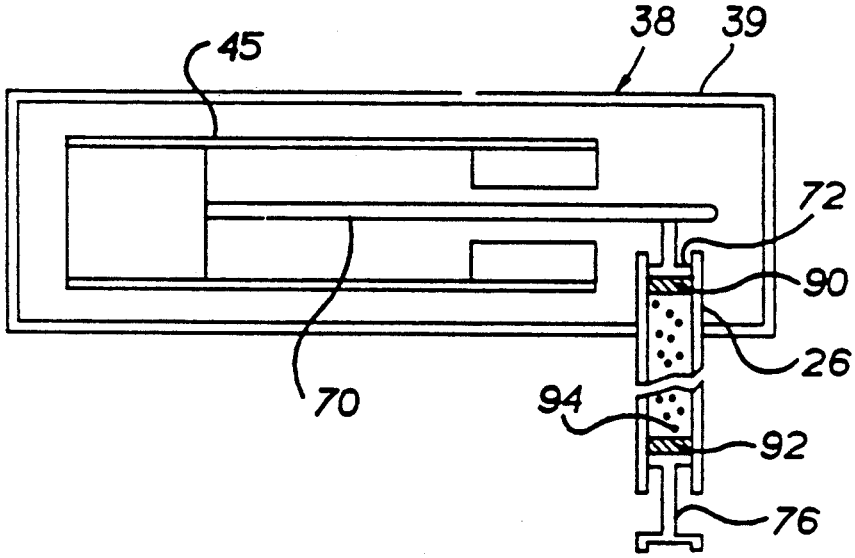
FIG. 6 is a detailed perspective view of the invention in a third embodiment.
Figure 7:
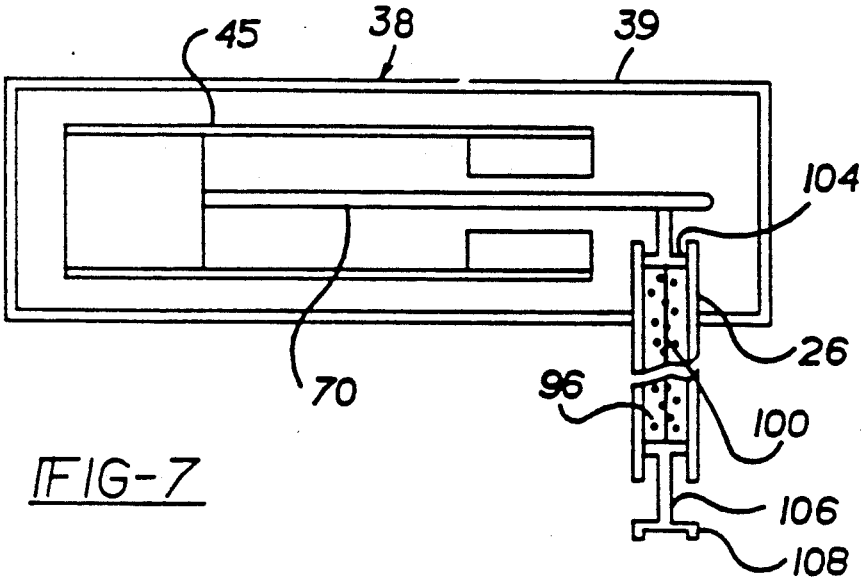
FIG. 7 is a detailed perspective view of the invention in a fourth embodiment.

FIGS. 5, 6, and 7 illustrate separate embodiments associated with the mechanical coupling of pressure level changes through tube 26 to the stapes. Specifically, as shown in FIG. 5, a housing 39 contains a coil 45 is provided and is made to contain a usual armature 70 which is vertically movable in response to a changing magnetic flux within coil 45. Connected to an end of armature 70 is a generally "T" shaped piston 72 having its expanded horizontal end 74 generally disposed within tube 26. A secondary generally "T" shaped piston 76 is also provided and has its expanded horizontal end 78 generally disposed within tube 26 while having a cup shaped opposite end 80 arranged such that it is contact with and secured to the stapes.

Tube 26 is filled with very low loss synthetic rubber material 82 such as Silastic® produced by the Dow Corning Company and pistons 72 and 76 are free to move therein. As the magnetic flux changes within coil 45, piston 72 is made to move in and out of tube 26 causing sound pressure level changes therein. These changes are transmitted by material 82 to piston 76 which moves in response thereto causing physical transmission of the transmitted pressure changes to the attached stapes.

It is known that sound vibration generally travels through a material filled tube, such as tube 26 in FIG. 5, with a velocity determined by the characteristic density of the material and the characteristic Young's modulus of the material. Specifically, the velocity is normally approximately computed as:

$$V=(Y/d)^{\frac{1}{2}} \qquad \text{(Equation 1)}$$

where "V" denotes calculated velocity, "Y" denotes the aforementioned Young's modulus; and "d" denotes the characteristic material density.

Further, it is known that if the characteristic impedance of tube 26 of FIG. 5 is matched to the mechanical impedance of the stapes, and cochlear complex, standing waves within the tube 26 will be minimized and maximum sound energy transfer to the stapes will result. The characteristic impedance of the tube 26 of FIG. 5 is known to be approximately computed as:

$$Z_m=S(d^{*}Y)^{\frac{1}{2}} \qquad \text{(Equation 2)}$$

where "$Z_m$" denotes the characteristic impedance of tube 26 and which is also determined by the characteristic density and Young's modulus of material 82, "S" denotes the cross-sectional area of tube 26, and "Y" determines the aforementioned Young's modulus of material 82.

It is also known that the mechanical loading of piston 76 by the attached stapes and cochlear complex can be estimated from Zwislocki's electrical network model of the ear and is:

$$L=jw\,(1\times10^{-3})+300+(1/jw)\,(1.2\times10^{-6}) \qquad \text{(Equation 3)}$$

where "L" denotes loading and is normally expressed in units of dyne-sec/cm and where "w" denotes radian frequency. It is additionally known that for frequencies below approximately 1.5 khz the mechanical loading is controlled by compliance, for frequencies above approximately 4.8 khz the mechanical loading is controlled by mass, and for frequencies from approximately 1.5 khz is approximately 4.8 khz the mechanical loading is controlled by damping. Thusly, in order to achieve a proper termination between the apparatus of the embodiment shown in FIG. 5 and the stapes, the characteristic mechanical impedance of the filled tube 26 should be approximately 300 dyne-sec/cm as determined from the cross-sectional area of the tube 26 and the density and elasticity of the aforementioned filling material 82 of the embodiment of FIG. 5.

When the aforementioned mechanical loading on tube 26 of FIG. 5 matches its characteristic impedance virtually no reflected sound waves are produced at the stapes end and it is further known that the following equation is applicable:

$$F_s/F_a=e^{-aL} \qquad \text{(Equation 4)}$$

where "$F_s$" denotes the force delivered to the stapes by piston 76, "$F_a$" denotes the force produced by the armature 70, "L" denotes the distance between pistons 72 and 76, and "a" is the real part of the propagation coefficient that reduces the amplitude of the transmitted wave corresponding to various mechanisms of mechanical loss such as viscosity and friction associated with material 82. In order to achieve less than a 10% attenuation of force "$F_a$", the value of "a" must be less than the value given by the following equation:

$$a<(1/L)\ ln\ (1/0.9) \qquad \text{(Equation 5)}$$

where "L" denotes the aforementioned distance between pistons 72 and 76. Specifically, for a tube 26 that is approximately two centimeters long, "a" must be less than approximately 0.05.

The advantages associated with the embodiment illustrated in FIG. 5 over that of FIG. 3, is that by employing a rather low loss and rather stiff material 82 such as Silastic®, a better impedance match with the stapes and cochlear complex is achieved with a much smaller sized mechanical termination (i.e., piston 76 instead of coupler 12). This reduction in termination size allows for a significant increase in visibility associated with the actual implantation of the apparatus of FIG. 5 over that shown generally in FIG. 3 thereby allowing for a relatively less surgically complicated task. Additionally, the use of material 82 allows for significant increases in the allowable length and bending of tube 26 in the embodiment of FIG. 5 relative to that of FIG. 3. The ability to use longer and more pliable tubes 26 also allows for a less complicated and more efficient surgical implantation task.

The tube 26 and pistons 72 and 76 are also preferably made of a stainless steel or titanium material.

Another embodiment of this invention is illustrated in FIG. 6 and utilizes compliant seals 92 and 92 which are mounted to pistons 72 and 76 respectively, and which seal pistons 90 and 92 from tube 26 such that a fluid 94 having lower attenuation characteristics than material 82 of FIG. 5 may be displaced therein. Fluid 94 thusly has the ability to more efficiently transfer generated wave pressures created by armature 70 to the stapes attached to piston 76. It should be noted that pistons 72 and 76 shown in FIGS. 5 and 6 are usually made of stainless steel and that Equations 1–5 and all associated relationships described with reference to the embodiment of FIG. 5 apply equally to the embodiment of FIG. 6.

Another embodiment of this invention is illustrated in FIG. 7 in which a stainless steel generally hollow tube 100 having a typical length of approximately five to ten millimeters and a typical outside diameter of approximately one-half of a millimeter is disposed. Tube 100 is shown as having flared end portions 104 and 106 integrally defined thereby with portion 106 having a usually cup shaped portion 108 which attaches to the stapes in substantially the same manner as previously described with reference to portion 80 of piston 76. End 104 is attached to armature 70 by brazing, or by use of standard epoxy material.

Tube 26 in combination with tube 100, in this preferred embodiment, provides a direct coupling of generated pressure waves from armature 70 to portion 108 and subsequently transfers this pressure to the attached stapes thusly greatly increasing the transmission efficiency of all of the embodiments illustrated in FIGS. 5 and 6. Further, a fluid or other low loss elastic material 96 may further be disposed within tube 26, in addition to member 100, and further act to further increase associated transmission efficiency. Equations 1-5 and all associated relationships developed with reference to the embodiment of FIG. 5 apply equally to the embodiment of FIG. 7 and the previously described advantages associated surgical implantation also apply to the embodiment of FIG. 7 as well.

from the foregoing it will be seen that the present invention provides a solution to the problem of electromechanical transducer placement within the middle ear cavity. While the invention has been illustrated in an application utilizing both a sound pick up and a sound delivery system, the invention may be adapted for other uses as well. For example, if direct stimulation of the cochlea is to be implemented, the sound delivery coupler may be eliminated, with the electrical signals from the sound reinforcement and processing package going directly to a cochlear implant. Accordingly, it should be understood that the present invention is capable of certain modifications without departing from the spirit of the invention as set forth in the appended claims.

What is claimed is

1. An acoustic coupler for transferring pressure vibrations generated by the movement of an armature of an inductive coil to a portion of a human ear comprising:

container means for acoustic signal transfer having a first end and a second end;

first piston means for connection to the armature and movably disposed in said first end of said container means;

second piston means for connection to ear structure and movably disposed in said second end of said container means; and means for attaching said second piston means to said portion of a human ear.

2. The acoustic coupler as set forth in claim 1 further comprising seal means for sealing said first and second piston means in said container means.

3. The acoustic coupler as set forth in claim 2 wherein said seal means comprises a first seal means adjacent said first piston means and a second seal means adjacent said second piston means.

4. The acoustic coupler as set forth in claim 1 further comprising connection means in said container means for connecting said first piston means to said second piston means.

5. The acoustic coupler as set forth in claim 4 wherein said connection means comprises a tubular member.

6. The acoustic coupler as set forth in claim 1 wherein said container means comprises a tubular member.

7. The acoustic coupler as set forth in claim 6 wherein said container means is a stainless steel tube.

8. The acoustic coupler as set forth in claim 1 further comprising elastic material in said container means.

9. The acoustic coupler as set forth in claim 6 wherein said container means is a titanium tube.

* * * * *

UNITED STATES PATENT AND TRADEMARK OFFICE

CERTIFICATE OF CORRECTION

PATENT NO. : 5,085,628

DATED : February 4, 1992

INVENTOR(S) : A. Maynard Engebretson and John Fredrickson

It is certified that error appears in the above-identified patent and that said Letters Patent is hereby corrected as shown below:

| | |
|---|---|
| Column 3, line 1; | after "middle" change "ea" to --ear--. |
| Column 5, line 43; | after "fitting" change "4" to --46--. |
| Column 7, line 12; | change "secondary" to --second--. |
| Column 7, line 68; | after "1.5 khz" change "is" to --to--. |
| Column 8, line 54; | after "seals" change "92" to --90--. |
| Column 9, line 27; | "from" should be --From--. |

Signed and Sealed this

First Day of June, 1993

Attest:

Michael K. Kirk

MICHAEL K. KIRK

Attesting Officer

Acting Commissioner of Patents and Trademarks